US009314754B2

(12) United States Patent
Dettling et al.

(10) Patent No.: US 9,314,754 B2
(45) **Date of Patent: *Apr. 19, 2016**

(54) ELECTROMAGNETIC STIRRING APPARATUS

(71) Applicant: General Electric Company, Schenectady, NY (US)

(72) Inventors: F. Allen Dettling, Loveland, CO (US); Brian K. Clay, Westminster, CO (US); Gordon K. Francis, Louisville, CO (US); Matthew K. Stonesmith, Louisville, CO (US); Thomas D. Szakas, Longmont, CO (US)

(73) Assignee: General Electric Company, Schenectady, NY (US)

( * ) Notice: Subject to any disclaimer, the term of this patent is extended or adjusted under 35 U.S.C. 154(b) by 584 days.

This patent is subject to a terminal disclaimer.

(21) Appl. No.: 13/764,526

(22) Filed: Feb. 11, 2013

(65) Prior Publication Data

US 2013/0155803 A1 Jun. 20, 2013

Related U.S. Application Data

(63) Continuation of application No. 12/540,899, filed on Aug. 13, 2009, now Pat. No. 8,398,297.

(51) Int. Cl.
*B01F 13/08* (2006.01)
*B01F 13/10* (2006.01)

(52) U.S. Cl.
CPC ..... *B01F 13/08* (2013.01); *B01F 13/0818* (2013.01); *B01F 13/1013* (2013.01); *B01F 13/1022* (2013.01)

(58) Field of Classification Search
CPC .. B01F 13/08; B01F 13/0818; B01F 13/1022; B01F 13/1013
USPC ..... 366/273–274; 266/234
See application file for complete search history.

(56) References Cited

U.S. PATENT DOCUMENTS 3,784,170 A 1/1974 Peterson et al.
4,054,270 A 10/1977 Gugger et al.

(Continued)

FOREIGN PATENT DOCUMENTS

DE 2201204 5/1973
DE 8106555.8 12/1981

(Continued)

OTHER PUBLICATIONS

Texas Instruments, Data Sheet for Single Schmitt-Trigger Inverter, SN74LVC1G14, SCE218C—Apr. 1999—Revised Feb. 2000, pp. 1-8, Texas Instruments, Dallas, Texas.

(Continued)

*Primary Examiner* — Charles Cooley
(74) *Attorney, Agent, or Firm* — Wegman, Hessler & Vanderburg

(57) ABSTRACT

The stirring apparatus is an electronic design that generates rotating magnetic fields to drive magnetic stir bars within vials placed above the cover of the stirring apparatus. Below the cover is a magnetics board containing multiple vial groups of four air core coils arranged in rectangular patterns. Each vial group has with two pairs of diagonal coils. The coils in each pair are wired in series and have opposite winding directions. Each pair is driven by a different phase of a stepper motor driver. The vial groups are spaced appropriately for placing one vial above each group. The adjacent coils of adjacent vial groups are driven by the same phase and have the same magnetic direction. The cover contains an array of pole standoffs that matches the coil pattern. The hollow center of each air core coil contains at least a portion of one pole standoff.

20 Claims, 14 Drawing Sheets

(56) References Cited

U.S. PATENT DOCUMENTS

| | | | | |
|---|---|---|---|---|
| 4,080,663 | A | 3/1978 | Wik | |
| 4,090,263 | A | 5/1978 | Hoffa | |
| 4,131,370 | A | 12/1978 | Lawrence et al. | |
| 4,199,265 | A * | 4/1980 | Sanderson | B01F 13/0818 366/274 |
| 4,214,874 | A | 7/1980 | White | |
| 4,227,815 | A | 10/1980 | Hoffa | |
| 4,390,283 | A | 6/1983 | Meyer | |
| 4,568,195 | A | 2/1986 | Herz et al. | |
| 4,752,138 | A | 6/1988 | Rufer | |
| 4,759,635 | A | 7/1988 | MacMichael et al. | |
| 4,830,511 | A | 5/1989 | Smazik | |
| 4,876,069 | A | 10/1989 | Jochimsen | |
| 4,911,555 | A | 3/1990 | Saffer et al. | |
| 4,991,973 | A | 2/1991 | Maaz et al. | |
| 5,529,391 | A * | 6/1996 | Kindman | B01F 15/065 366/145 |
| 5,899,567 | A | 5/1999 | Morris, Jr. | |
| 5,911,503 | A | 6/1999 | Braden et al. | |
| D426,312 | S | 6/2000 | Gomes | |
| 6,508,582 | B2 | 1/2003 | Friedman | |
| 6,659,637 | B2 | 12/2003 | Friedman | |
| 6,733,171 | B2 | 5/2004 | Schöb | |
| 6,905,656 | B1 | 6/2005 | Ladlow et al. | |
| 6,962,433 | B2 * | 11/2005 | Nichols | B01F 13/0818 366/274 |
| 6,988,825 | B2 | 1/2006 | Coville et al. | |
| 7,040,800 | B2 * | 5/2006 | Brauch | B01F 13/0818 366/274 |
| 7,075,040 | B2 | 7/2006 | McFadden et al. | |
| 7,153,021 | B2 | 12/2006 | Goodwin et al. | |
| 7,364,350 | B2 | 4/2008 | Coville et al. | |
| 7,494,267 | B2 | 2/2009 | Ware | |
| 7,972,556 | B2 * | 7/2011 | Araseki | B01F 13/0809 266/233 |
| 8,398,297 | B2 * | 3/2013 | Dettling | B01F 13/0818 366/274 |
| 2004/0151065 | A1 | 8/2004 | Nichols et al. | |
| 2010/0148411 | A1 * | 6/2010 | Araseki | B01F 13/0809 266/234 |
| 2011/0038224 | A1 * | 2/2011 | Dettling | B01F 13/0818 366/274 |
| 2013/0155803 | A1 * | 6/2013 | Dettling | B01F 13/0818 366/274 |

FOREIGN PATENT DOCUMENTS

| | | |
|---|---|---|
| DE | 3043335 | 6/1982 |
| EP | 1201297 | 5/2002 |
| GB | 156206 | 6/1969 |
| WO | 91/10503 | 7/1991 |

OTHER PUBLICATIONS

Allegro Microsystems, Inc., Data Sheet for Microstepping DMOS Driver with Translator, A3979, pp. 1-14, Allegro Microsystems, Inc., Worcester, Massachusetts, www.allegromicro.com. (Jan. 2005).

National Semiconductor Corporation, Data Sheet for LM117/LM317A/LM317 3—Terminal Adjustable Regulator, 9063, Oct. 20, 2008, pp. 1-28, National Semiconductor Americas Technical Support Center, www.national.com.

Linear Technology Corporation, Data Sheet for LTC1440/LTC1441/LTC1442 Ultralow Power Single/Dual Comparator with Reference, 144012fd, pp. 1-16, Linear Technology Corporation, Milpitas, CA, www.linear.com (Jan. 1996).

Maxim Integrated Products, Data Sheet for MAX1615/MAX1616 High-Voltage, Low-Power Linear Regulators for Notebook Computers, 19-1225; Rev 3; Sep. 2004, pp. 1-8, Maxim Integrated Products, Sunnyvale CA, www.maxim-ic.com/packages.

International Search Report and Written Opinion mailed Jan. 4, 2012 for PCT/US2010/039614; filed Jun. 23, 2010.

International Preliminary Report on Patentability mailed Feb. 14, 2012 for PCT/US2010/039614; filed Jun. 23, 2010.

* cited by examiner

ELECTROMAGNETIC STIRRING APPARATUS

CROSS-REFERENCE TO RELATED APPLICATIONS

This application is a continuation application of and claims the priority filing benefit of U.S. patent application Ser. No. 12/540,899, filed Aug. 13, 2009, now U.S. Pat. No. 8,398,297, and entitled "Electromagnetic Stirring Apparatus", which is herein incorporated by reference in its entirety.

BACKGROUND OF THE INVENTION

1. Field of Invention

The present invention relates generally to a magnetic stirring apparatus.

2. Description of Related Art

The fields of biology and chemistry require the stirring of liquids and suspensions in target vials prior to and during sampling. Accordingly, a variety of stirring devices have been developed over the years, several of which were used in conjunction with autosamplers. Some previous devices utilized magnets mounted on motors that moved in space around or under the target vials. However, the motors only had an operating life of about 2000 hours, which made such designs unreliable for use with an autosampler that operates upwards of 8000 hours a year. Further, the placement of magnets between the target vials and the size of the magnets required to achieve active coupling with the stir bars decreased the number of vials that could be placed in a given area.

Other devices drove multiple stir bar locations simultaneously by placing pole shoes on top of coils and utilizing the pole shoes to direct a shared magnetic field under multiple vials placed in close proximity to one another. However, these pole shoe devices did not provide an acceptable consistent stirring action because the strength vector of the shared magnetic field became distorted by the magnetic stir bars placed in the vials. The distorted magnetic field resulted in the application of a strong magnetic field to the stir bars in some vials, and a weak magnetic field to the stir bars in other vials.

Accordingly, a need exists for a reliable stirring device that is capable of stirring samples contained in target vials placed in close proximity to one another and applies an individual and consistent magnetic field strength vector to the stir bar in each vial. The present invention addresses one or more of these needs.

SUMMARY OF INVENTIVE FEATURES

The stirring apparatus is an electronic design that generates rotating magnetic fields to drive magnetic stir bars within vials placed above the cover of the stirring apparatus. The stir bar in each vial is driven by a separate magnetic field. The cover acts as a vial seating plane. Below the cover is a magnetics board containing multiple vial groups of air core coils. The cover contains an array of pole standoffs that matches the coil pattern. The hollow center of each air core coil contains at least a portion of one pole standoff. The heads of the pole standoffs extend through the cover and are flush with the top surface of the cover.

Embodiments of this invention contain one or more of these and other features and advantages described in, or made apparent from, the above summary of inventive features and the following detailed description of various exemplary embodiments of this invention.

BRIEF DESCRIPTION OF THE DRAWINGS

The structure, operation, and advantages of the presently disclosed embodiment of the invention will become apparent when consideration of the following description taken in conjunction with the accompanying drawings wherein.

DETAILED DESCRIPTION OF THE EXEMPLARY EMBODIMENTS

The invention will now be described in the following detailed description with reference to the drawings, wherein preferred embodiments are described in detail to enable practice of the invention. Although the invention is described with reference to these specific preferred embodiments, it will be understood that the invention is not limited to these preferred embodiments. But to the contrary, the invention includes numerous alternatives, modifications and equivalents as will become apparent from consideration of the following detailed description.

Figure 1:
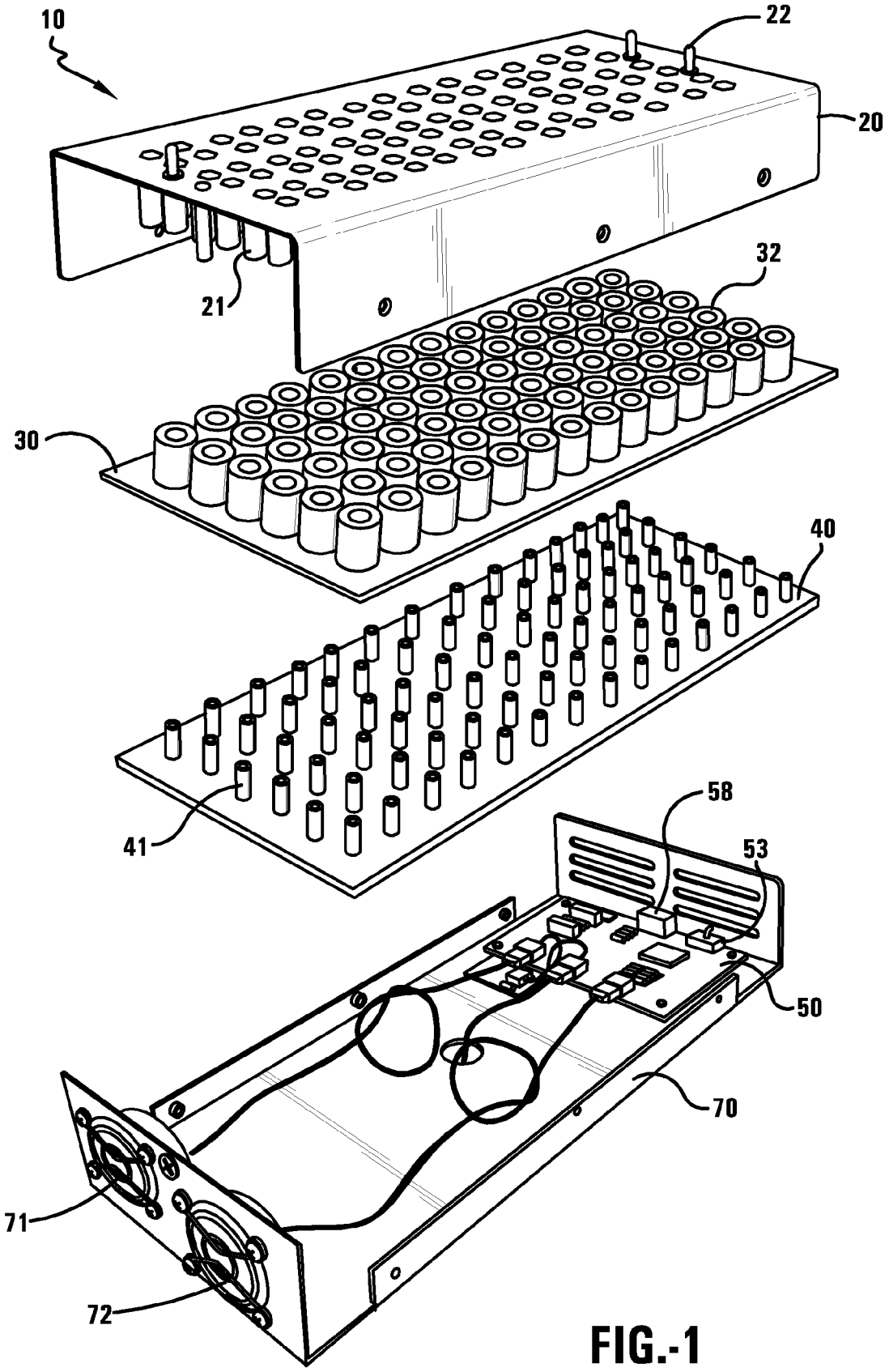
FIG. 1 is an exploded view of an embodiment of the invention.

Referring now to the drawings, the stirring apparatus 10 of FIG. 1 comprises a cover 20, magnetics board 30, coupling plane 40, driver board 50, and base 70. In the preferred embodiment, magnetics board 30 is mechanically fastened to cover 20; cover 20 and driver board 50 are mechanically fastened to base 70. Further, in the preferred embodiment, index pins 22 protrude from the top surface of the cover 20 and are used to position a vial rack on cover 20. Some embodiments include coupling plane 40, which is located below magnetics board 30 and mechanically fastened to cover 20.

Figure 2:
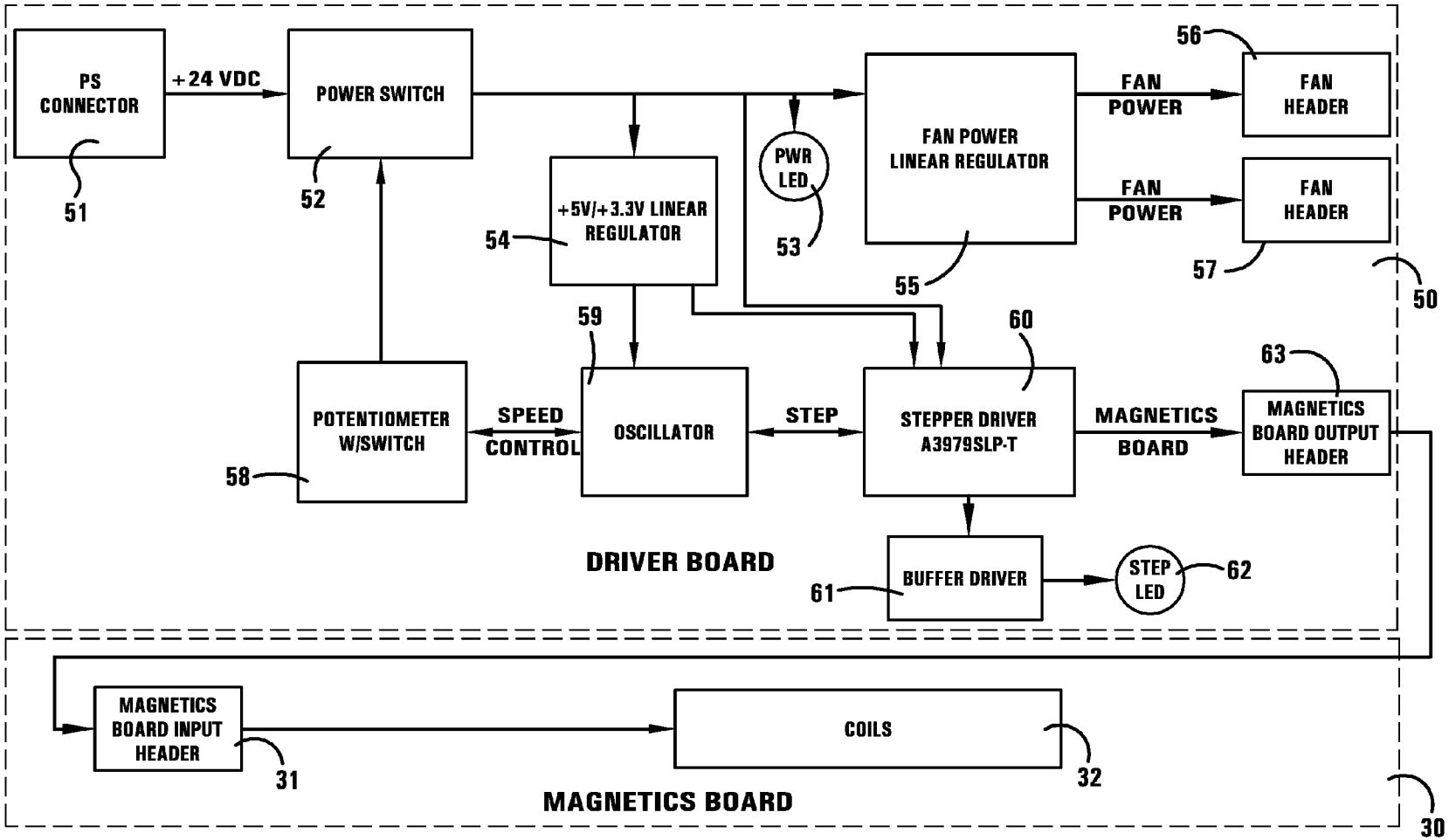
FIG. 2 is a block diagram of the driver board and magnetics board of FIG. 1.

FIG. 2 shows a block diagram of the driver board 50 and magnetics board 30. Driver board 50 has a power supply connector 51 which provides power to power switch 52. Power switch 52 provides power to potentiometer 58, linear regulator 54, power LED 53, stepper driver 60, and fan power regulator 55. The fan power linear regulator 55 provides power to fans 71 and 72 through fan headers 56 and 57. Linear regulator 54 provides power to oscillator 59 and stepper driver 60. Potentiometer 58 has a switch that controls the ON/OFF state of stirring apparatus 10 in conjunction with power switch 52. Further, potentiometer 58 operates in conjunction with oscillator 59 to control the step speed of stepper driver 60. Further, stepper driver 60 provides an output to magnetics board 30 through magnetics board output header 63 and magnetics board input header 31. In some embodiments, driver board 50 contains step LED 62 which illuminates whenever the magnetic fields driving the magnetic stir bars complete a full rotation and return to their home index positions.

Figure 3A:
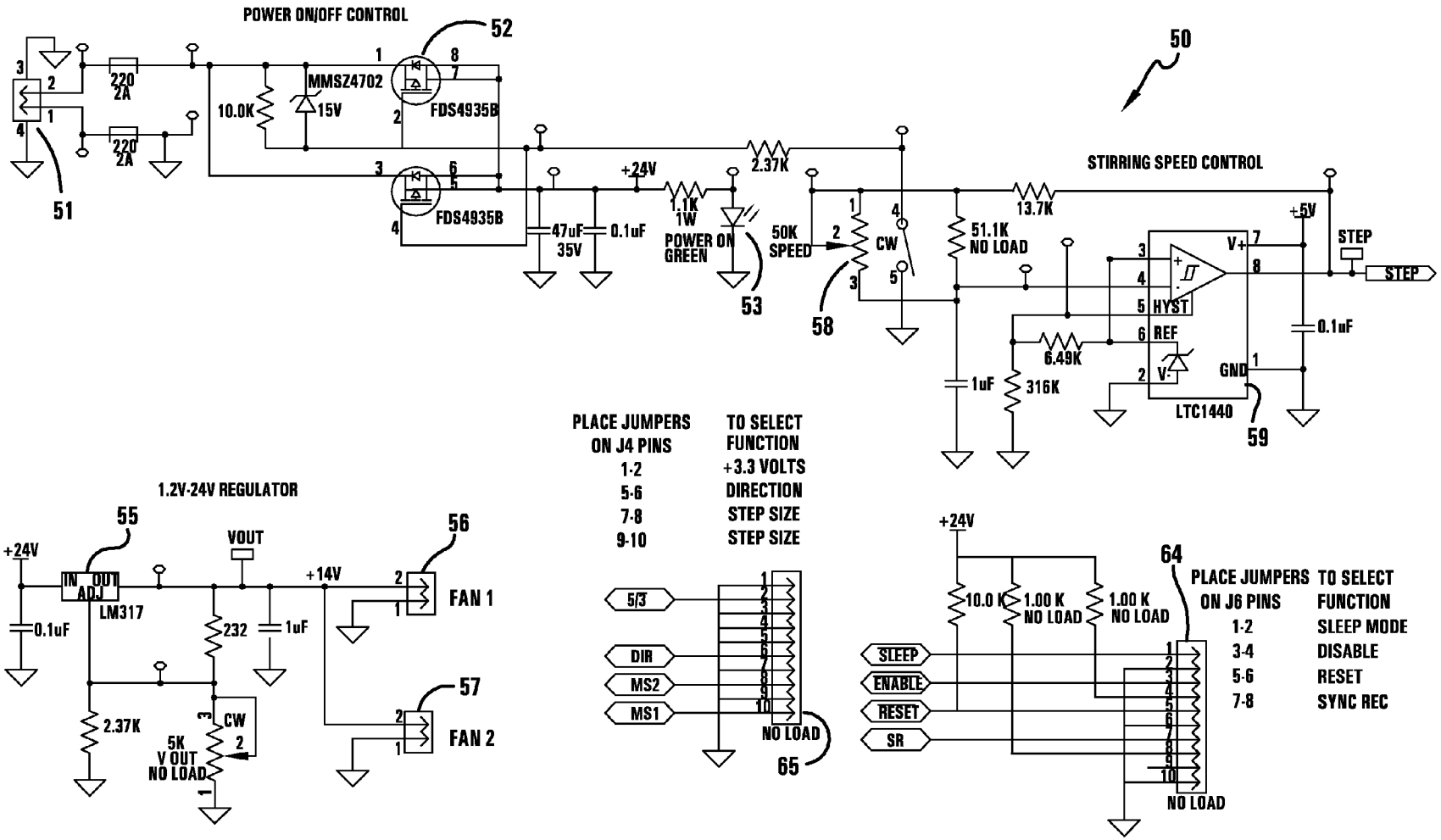
FIG. 3A-B are electrical schematics of the driver board of FIGS. 1 and 2.
Figure 3B:
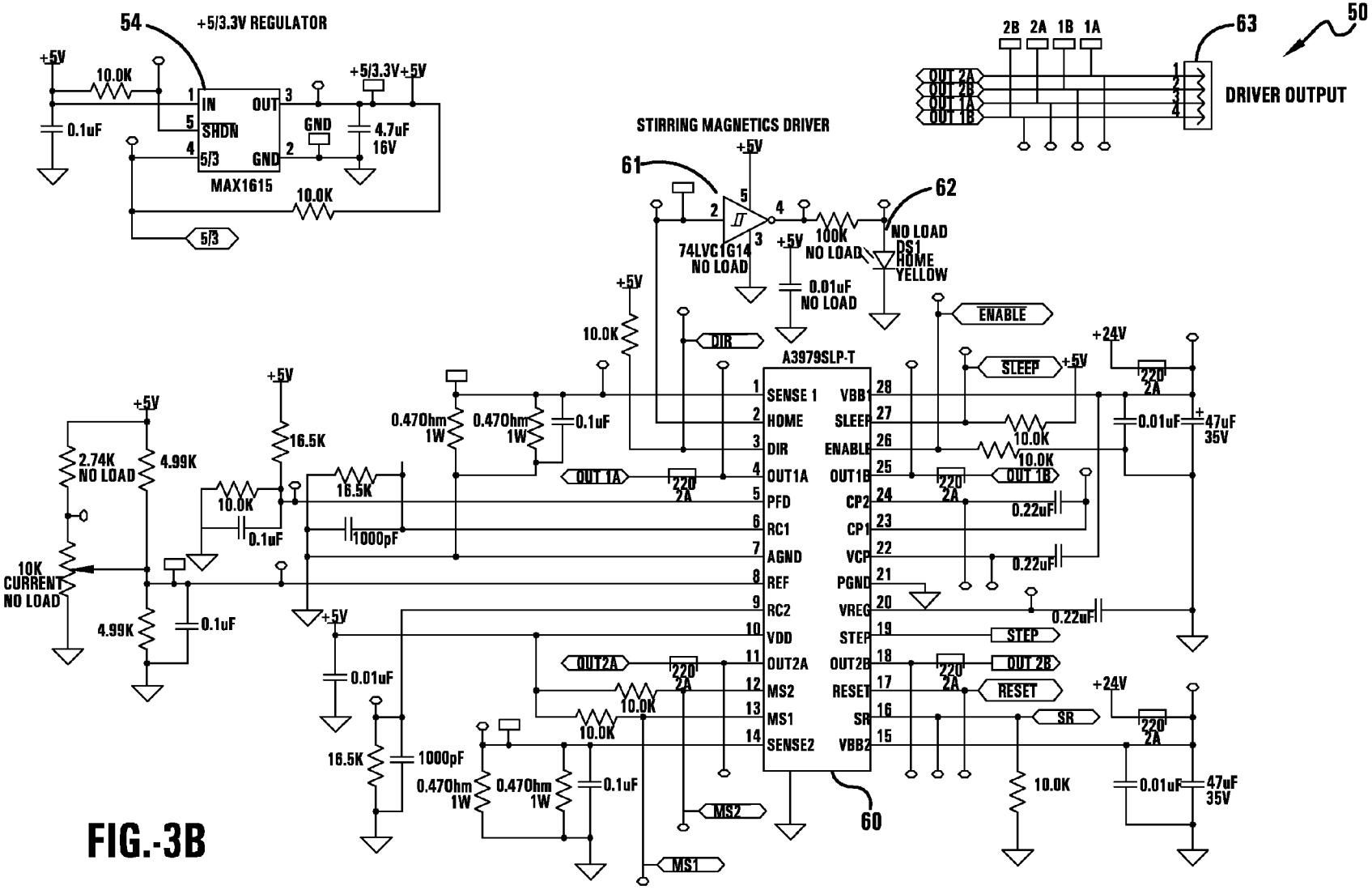

FIG. 3 A-B contains a schematic representation of driver board 50 that contains a first configuration header 64 and a second configuration header 65 to control various functions on stepper driver 60. First configuration header 64 allows for the selection of the synchronous rectification and sleep mode functions, along with allowing a user to reset and disable/enable stepper driver 60. Second configuration header 65 allows for the selection of the logic supply voltage and the direction and step size of the output of stepper driver 60. Second configuration header 65 can be set to allow stepper driver 60 to run in 1/16 step, 1/4 step, 1/2 step, or full step mode, which creates between 4 and 32 pole positions at intervals in each vial group of four coils 33. Further, the Vref of stepper driver 60 is set by a voltage divider resistor circuit to limit the peak current going through coils 33. The driver board 50 provides for the optional installation of a potentiometer to control the peak motor current via the Vref input.

Oscillator 59 is a simple comparator circuit that utilizes a resistor, capacitor and potentiometer 58 to set the oscillation frequency. In the preferred embodiment, the frequency can be adjusted between 300-1280 Hz, which translates to a stirring frequency between 280-1200 RPM.

In the preferred embodiment, stepper driver 60 of driver board 50 is configured to produce a micro-step output at 1/16 step, which results in two phases of pseudo-sine waves 90° out of phase from one another. When compared to an output of 1/2 step, a micro-step output of 1/16 step improves the stirring action and maintains a consistent magnetic field strength vector throughout the field rotation because the 1/16 step increments decrease the lead between the new field position and stir bar after indexing. Further, the Vref of stepper driver 60 is set for a peak current of 1.33 A, which limits the overall power of the preferred embodiment to about 15 W. Additionally, the input voltage of PFD (percentage fast decay) is fixed at 0.37 VDD, which switches the output current decay mote to the mixed decay mode when a STEP input signal commands a lower output current than the previous step.

In the preferred embodiment, linear regulator 54 is part number MAX1615 from Maxim Integrated Products; fan power linear regulator 55 is part number LM317 from National Semiconductor Corporation; oscillator 59 is part number LTC1440 from Linear Technology Corporation; stepper driver 60 is part number A3979SLP-T from Allegro MicroSystems, Inc.; and buffer driver 61 is part number 74LVC1G14 from Texas Instruments Incorporated. The datasheets for the part numbers listed in this paragraph are hereby incorporated by reference.

Figure 4A:
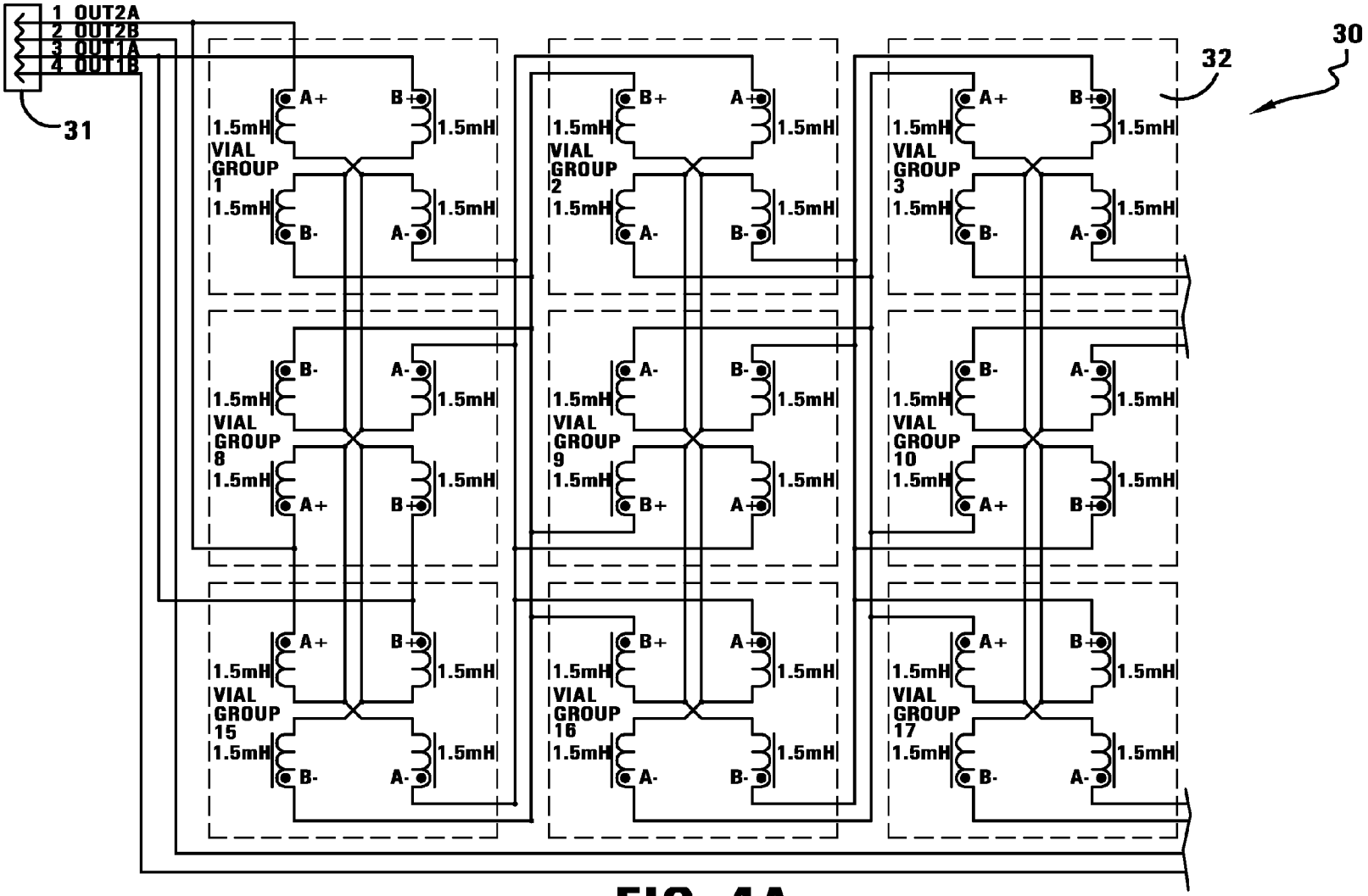
FIG. 4A-B are electrical schematics of the magnetics board of FIGS. 1 and 2.
Figure 4B:
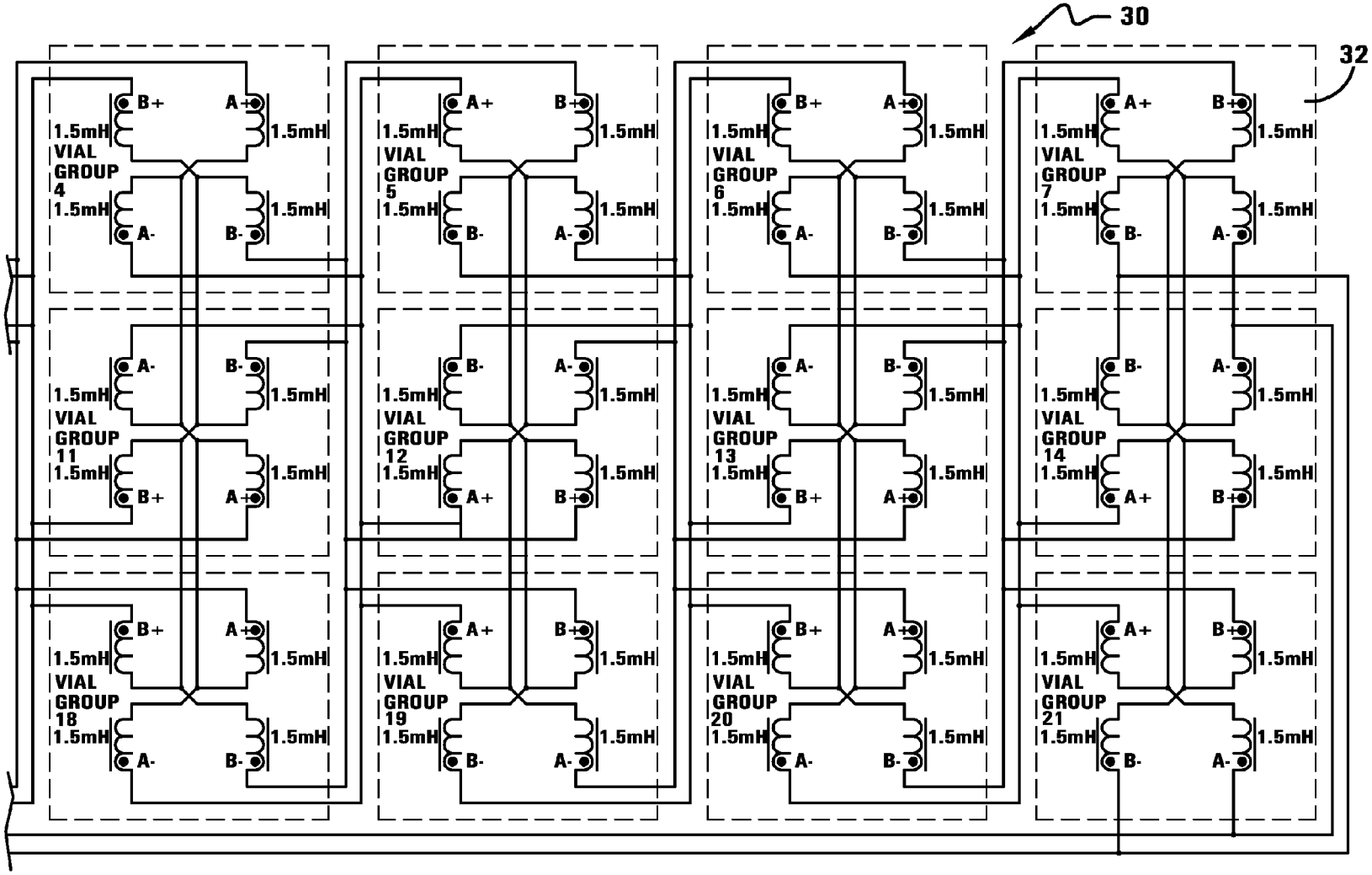
Figure 5:
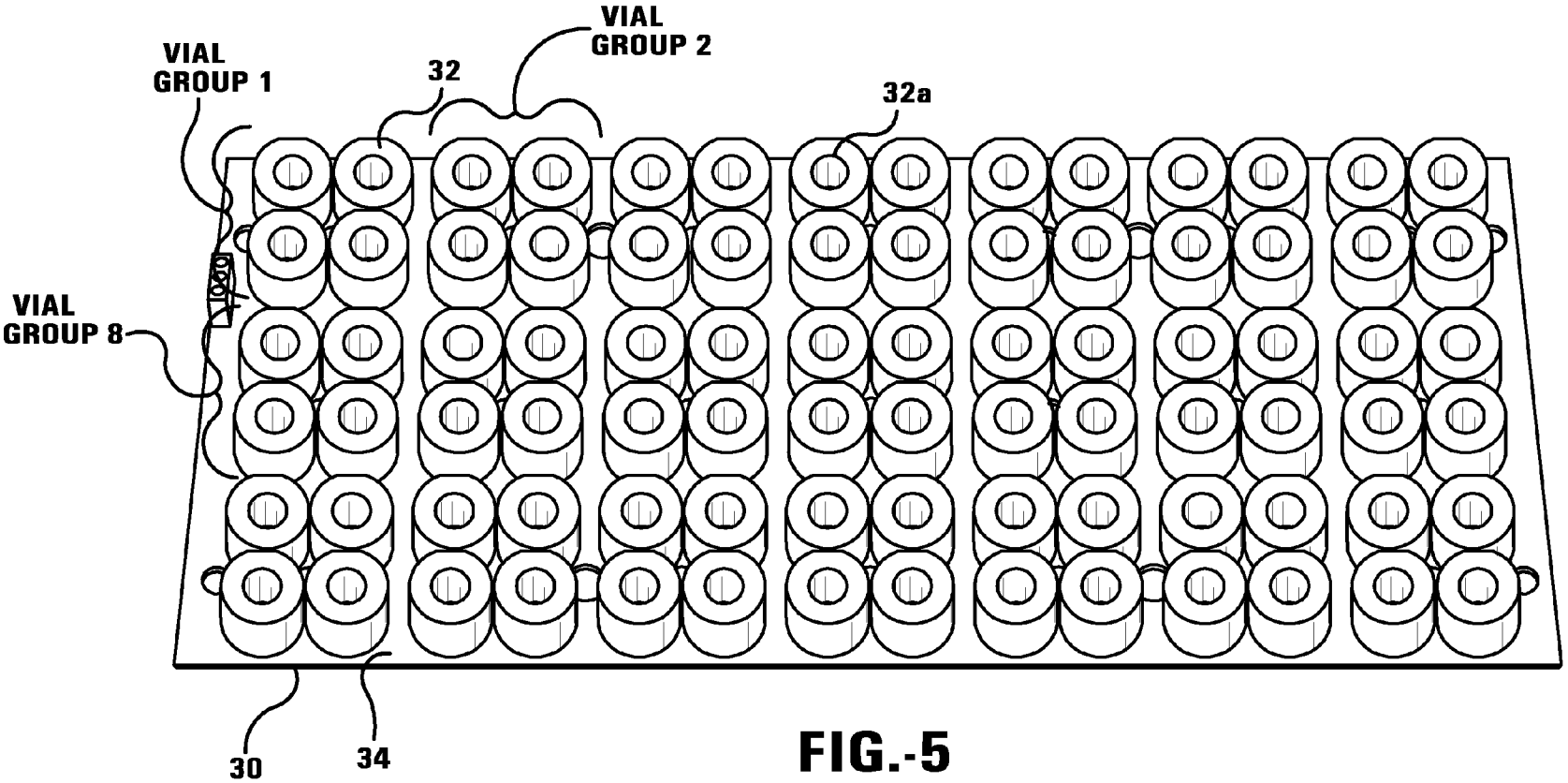
FIG. 5 is a perspective view of the magnetics board of FIGS. 1, 2, and 4.
Figure 6:
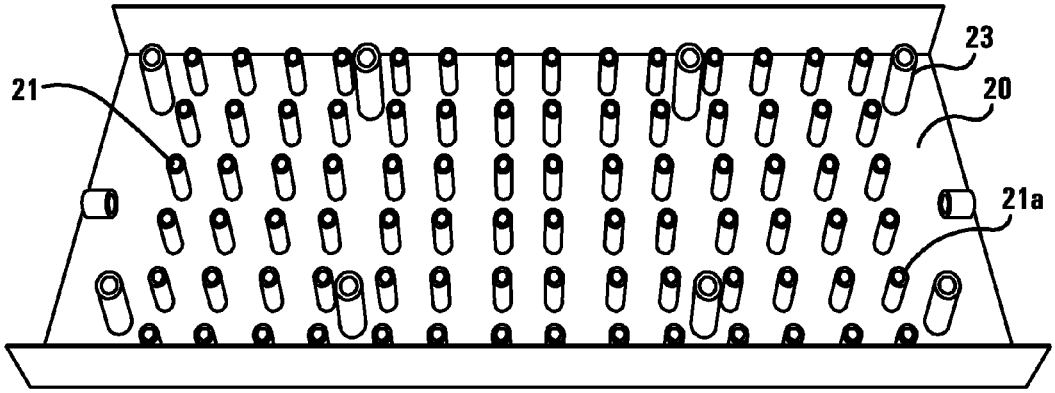
FIG. 6 is a perspective view of the cover of FIG. 1.
Figure 7:
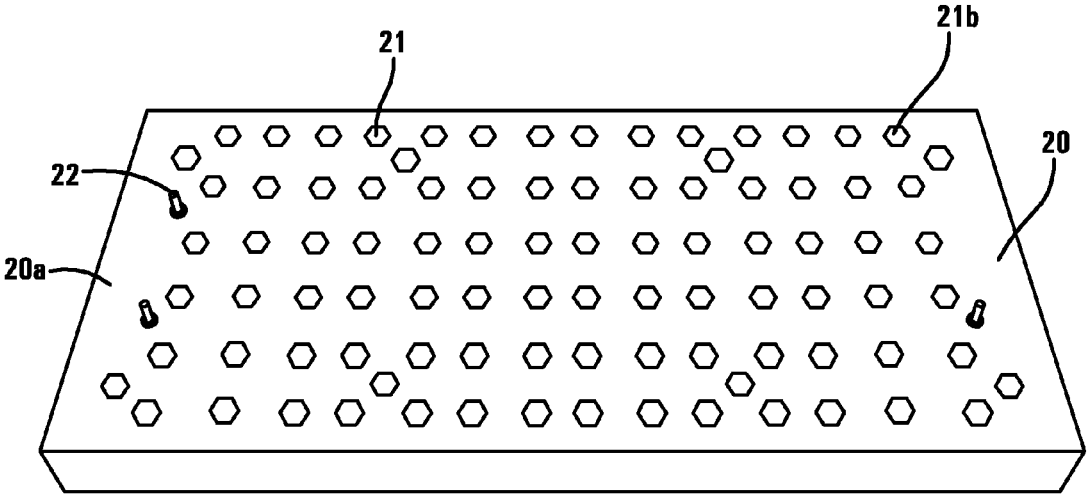
FIG. 7 is a perspective view of the cover of FIG. 1.
Figure 8:
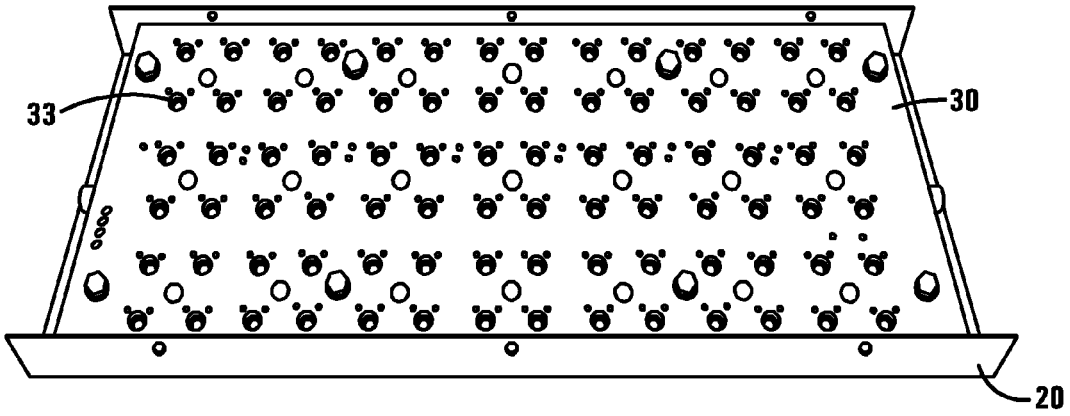
FIG. 8 is a perspective view of the cover and magnetics board of FIGS. 1, 2, and 4.
Figure 9:
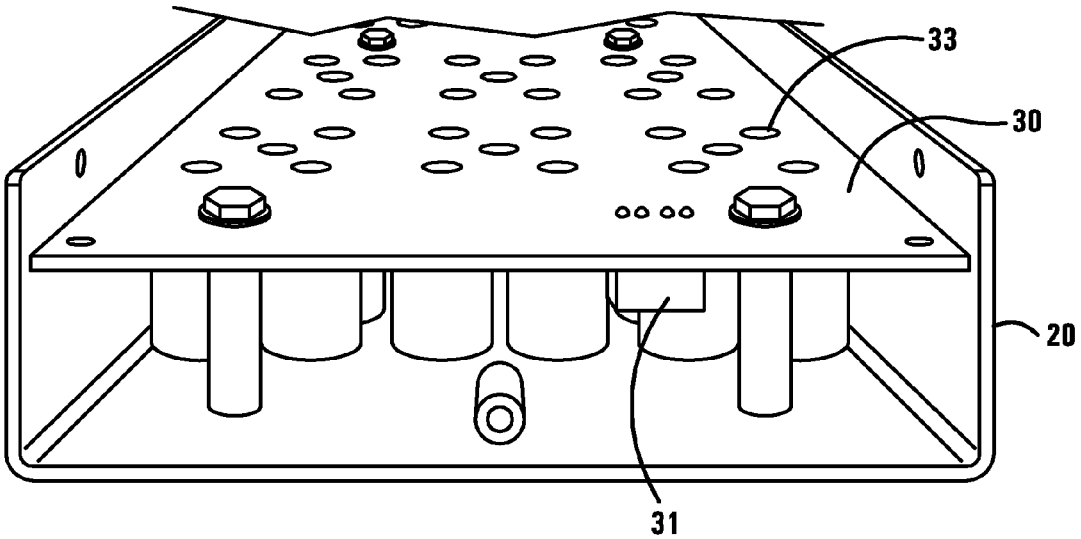
FIG. 9 is a perspective view of the cover and magnetics board of FIGS. 1, 2, and 4.

Magnetics board 30 of FIGS. 4A-B and 5 comprises 21 vial groups of four air core coils 32. The coils 32 in the vial groups are arranged in a rectangular pattern and mounted perpendicular to the top surface 34 of magnetics board 30. The vial groups of four coils 32 are spaced appropriately for placing one target vial above each vial group. Each vial group generates an individual magnetic field that drives a magnetic stir bar in a target vial placed above the vial group. It is contemplated that a magnetics board 30 having more or less than 21 vial groups can be used without departing from the scope of the invention.

In the preferred embodiment, coils 32 in the vial groups are arranged in a square pattern with 0.6 inch sides. The coils 32 are centered on the vertices of the square pattern. The vial groups are organized in a three by seven matrix on a printed circuit board. Further, in the preferred embodiment, coils 32 are part number 1159W1-RF from Triad Magnetics.

Coils 32 are driven by the two phases of stepper driver 60 (phase 1 and phase 2). Accordingly, each vial group of four coils 32 has one pair of coils 32 wound in opposite directions and wired in series to phase 1, and a second pair of coils 32 wound in opposite directions and wired in series to phase 2. In each vial group, the phase 1 coil pair and phase 2 coil pair are diagonal from one another. Therefore, when current flows through a pair of coils, the diagonal coils produce magnetic fields oriented in opposite directions.

The coils 32 are wired to create multiple sets of parallel coils in series for each phase of electrical power. In the preferred embodiment, each phase has 14 sets of three parallel coils 32 connected in series. This configuration ensures that the loss of a single coil 32 will not cause diminished stirring capability in more than one position. Further, tests have shown that the preferred embodiment can effectively stir a vial when only three of the four coils 32 are functioning in a vial group.

The adjacent (directly opposing) coils 32 of adjacent vial groups are driven by the same phase and have the same magnetic direction, which minimizes the corruption of the magnetic field produced by adjacent vial groups. This is illustrated in FIGS. 4A and 5 in which one coil 32 in each vial group is designated as an A+, A−, B+, or B-coil 32. The "A" coils 32 are connected to phase 1 and the "B" coils 32 are connected to phase 2. The "+" coils 32 are the first coils 32 in the pair and the "−" coils 32 are the second coils 32 in the pair. Looking at the adjacent (directly opposing) coils 32 of adjacent vial groups 1 and 2, it can be seen that the adjacent (directly opposing) upper coils 32 are B+and the adjacent (directly opposing) lower coils 32 are A−. Further, looking at the adjacent (directly opposing) coils 32 of adjacent vial groups 1 and 8, it can be seen that the adjacent ldirectly opposing) coils 32 on the left are B−and the adjacent (directly opposing) coils 32 on the right are A−.

If the adjacent (directly opposing) coils 32 of adjacent vial groups are not driven by the same phase and do not have the same magnetic direction, an adjacent (directly opposing) coil 32 from a first adjacent vial group could incorrectly couple with an adjacent (directly opposing) coil 32 from a second adjacent vial group, instead of correctly coupling with its paired coil 32 driven by the same phase in the first vial group. This incorrect coupling would corrupt the magnetic field produced by each vial group and disrupt stirring.

The likelihood of incorrect coupling increases if the distance between the adjacent (directly opposing) coils 32 of adjacent vial groups is less than the distance between the diagonal coil pairs. As can be seen in FIG. 5, the coils 32 on the right side of vial group 1 are closer to the adjacent (directly opposing) coils 32 on the left side of vial group 2, than to their diagonal pairs on the left side of vial group 1. In the preferred embodiment, the distance between the centers of coils 32 on the right side of vial group 1 and the centers of coils 32 on the left side of vial group 2 is 0.72 inches. Additionally, the distance between the coil 32 in the upper right corner of vial group 1 and its pair in the lower left corner of vial group 1 is 0.937 inches.

Cover 20 of FIGS. 6-9 contains construction standoffs 23, which are used to mechanically fasten magnetics board 30, and coupling plane 40 if present, to cover 20. Further, cover 20 contains an array of pole standoffs 21 that are of sufficient length and spaced such that the hollow center of each air core coil 32 on magnetics board 30 contains at least a portion of one pole standoff 21 when stirring apparatus 10 is assembled. Pole standoffs 21 have a distal end 21*a* and a head 21*b*. Pole standoffs 21 act as pseudo-cores for air core coils 32.

The heads 21*b* of pole standoffs 21 extend through cover 20 and are flush with the top surface 20*a* of cover 20, thereby placing the magnetic poles on the top surface 20*a* of cover 20. Moving the poles from the top 32*a* of coils 32 to the top surface 20*a* of cover 20 resulted in a 100% increase in field strength at the top surface 20*a* of cover 20. In some embodiments, pole standoffs 21 extend through the entire length of coils 32. A variety of components can be used as pole standoffs 21, including, but not limited to, threaded standoffs or unthreaded studs. In some embodiments, pole standoffs 21 are threaded 1 inch carbon steel PEM self clinching standoffs from PennEngineering, part number BSO-6440-24. In other embodiments, pole standoffs 21 are unthreaded carbon steel PEM self clinching studs from PennEngineering, part number FH-215-24ZI. In the preferred embodiment, cover 20 is aluminum.

Figure 10:
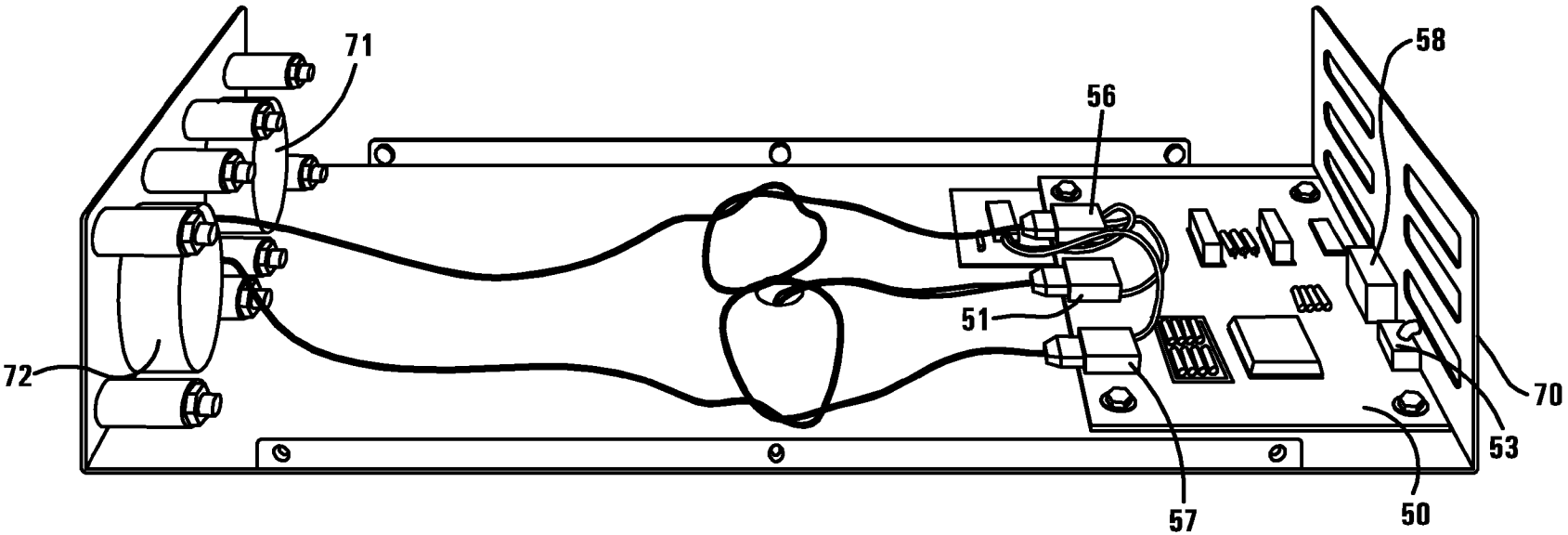
FIG. 10 is a perspective view of the base, driver board, and fans of FIG. 1.

FIG. 10 depicts the base 70, driver board 50, and fans 71 and 72. Also depicted on driver board 50 is power supply connector 51, power LED 53, fan headers 56 and 57, and potentiometer 58.

Figure 11:
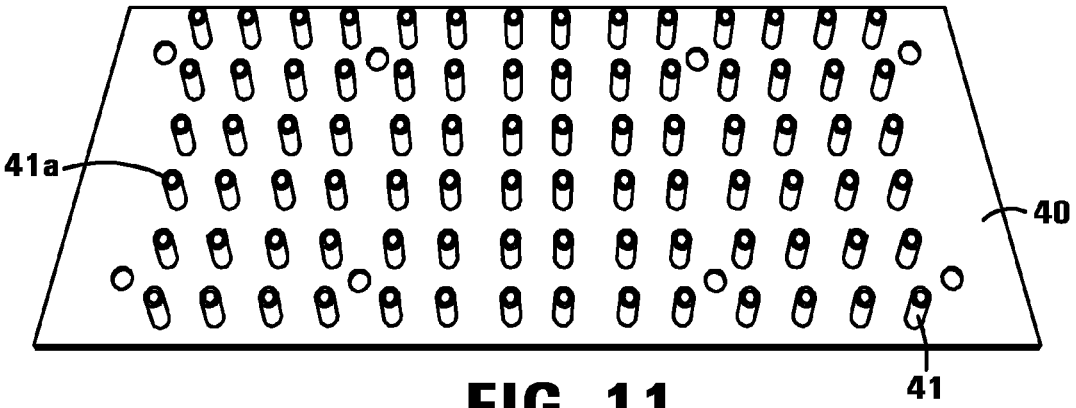
FIG. 11 is a perspective view of the coupling plane of FIG. 1.
Figure 12:
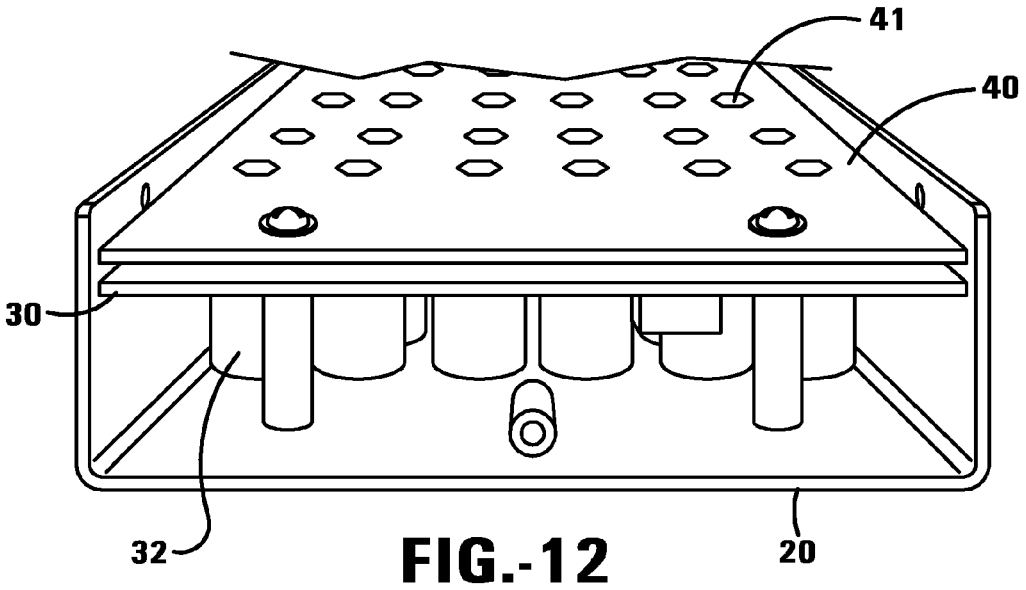
FIG. 12 is a perspective view of the coupling plane, magnetics board, and cover of FIG. 1.

Some embodiments of magnetic stirring apparatus 10 include coupling plane 40, one embodiment of which is depicted in FIGS. 11 and 12. Coupling plane 40 increases the magnetic field strength at the top surface 20*a* of cover 20 by about 50%.

Embodiments that include coupling plane 40 also have apertures 33 under each coil 32 of magnetics board 30. These apertures 33 allow coupling standoffs 41 or pole standoffs 21 to pass through magnetics board 30. In some embodiments, coupling plane 40 contains an array of coupling standoffs 41 that are of sufficient length and spaced such that the hollow center of each air core coil 32 on magnetics board 30 contains a portion of one coupling standoff 41. Coupling standoffs 41 act as pseudo-cores for air core coils 32.

In some embodiments that utilize coupling plane 40 with coupling standoffs 41, the distal end 41*a* of coupling standoffs 41 contact the distal end 21*a* of pole standoffs 21. In other embodiments that utilize coupling plane 40 with coupling standoffs 41, there is a gap between the distal end 21*a* of pole standoffs 21 and the distal end 41*a* of coupling standoffs 41.

A variety of components can be used as coupling standoffs 41, including, but not limited to, threaded standoffs or non-threaded studs. In some embodiments, coupling plane 40 is steel and coupling standoffs 41 are carbon steel PEM self clinching standoffs from PennEngineering, part number BSO-6440-16.

In some embodiments, coupling plane 40 is a sheet of steel and does not contain an array of coupling standoffs 41. In some embodiments that utilize a coupling plane 40 without coupling standoffs 41, the distal end 21*a* of pole standoffs 21 extend through the hollow center of each air core coil 32 and contact coupling plane 40. In other embodiments that utilize a coupling plane 40 without coupling standoffs 41, there is a gap between the distal end 21*a* of pole standoffs 21 and coupling plane 40.

Figure 13:
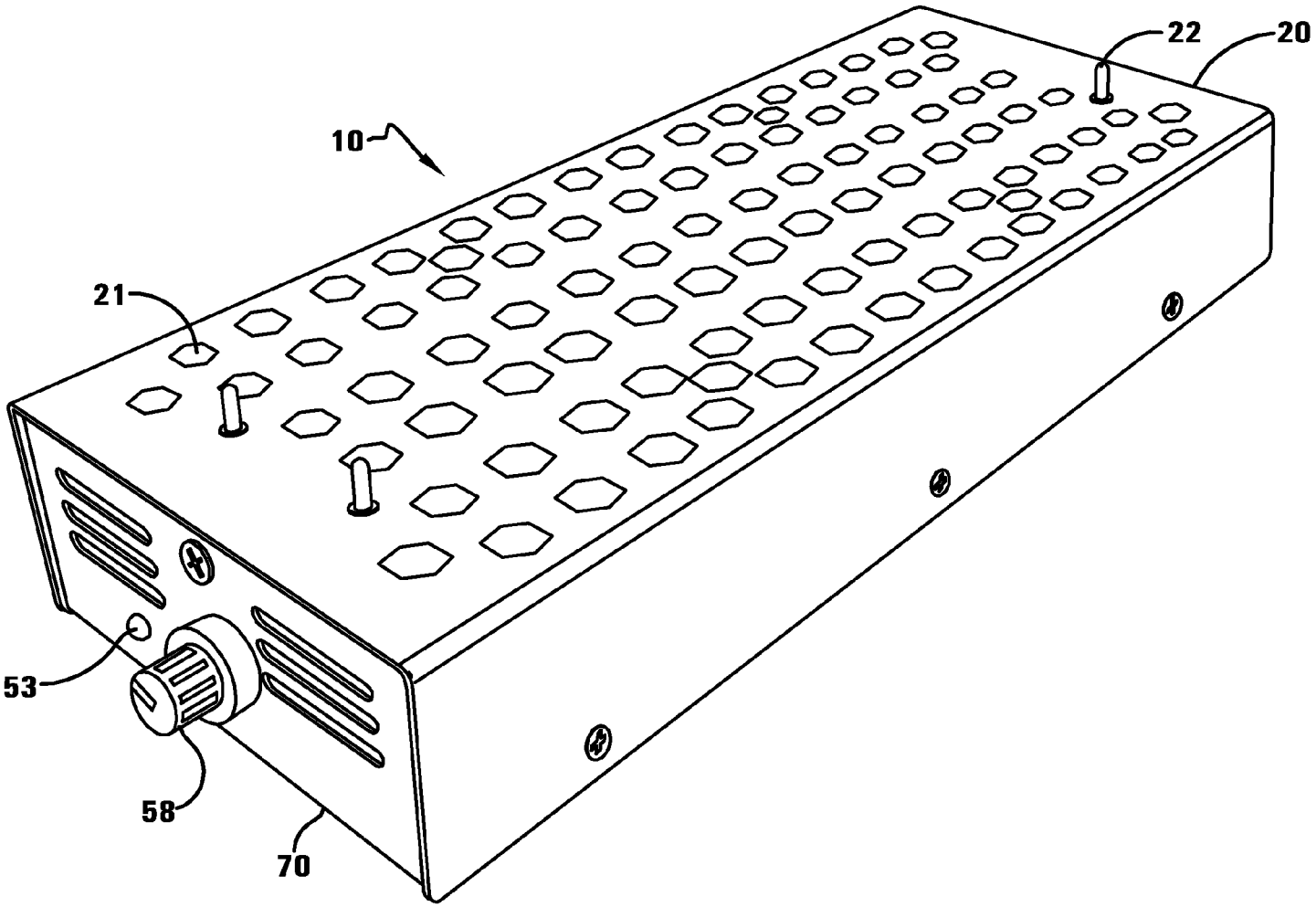
FIG. 13 is a front perspective view of an embodiment of the invention.
Figure 14:
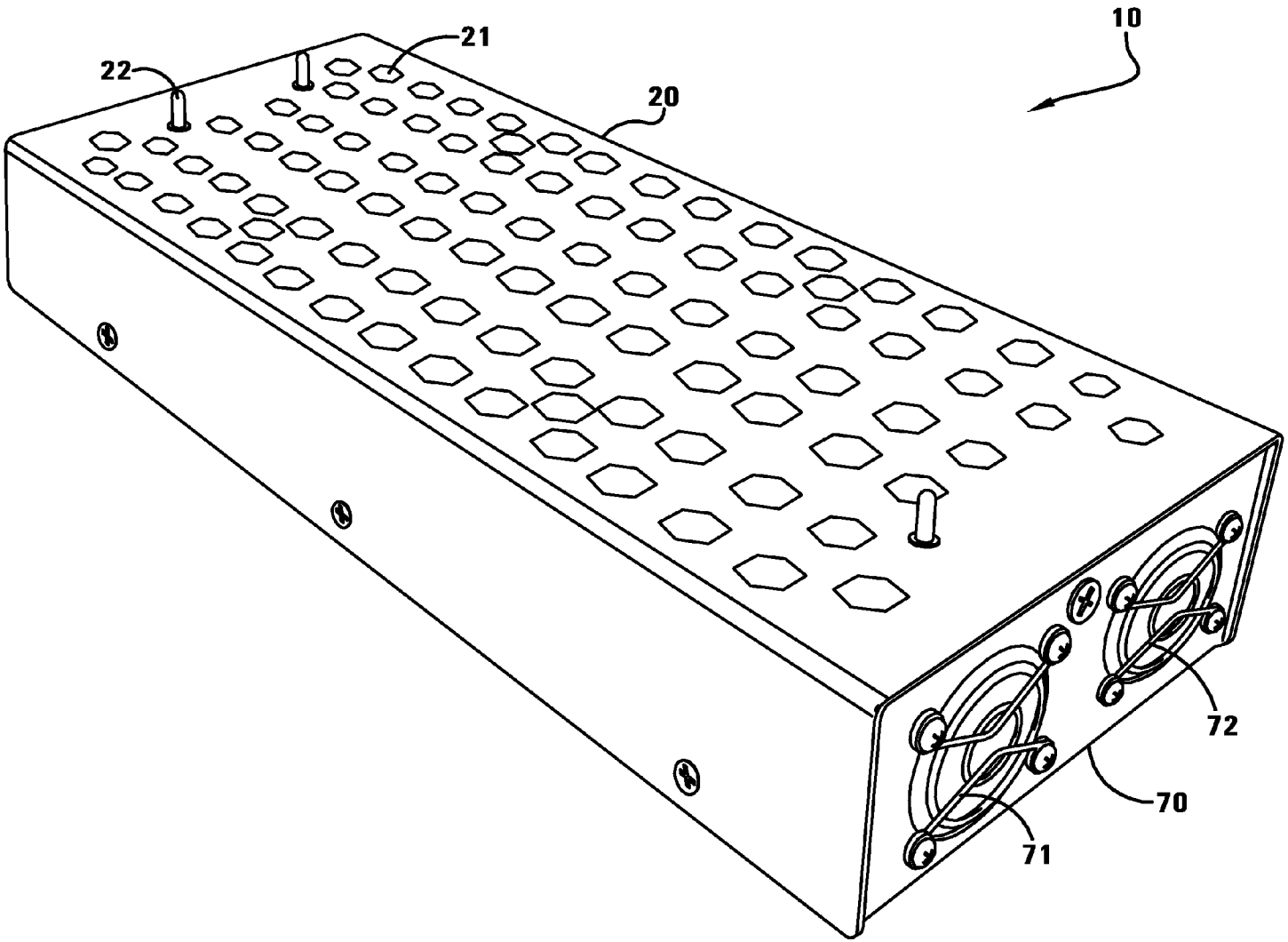
FIG. 14 is a rear perspective view of an embodiment of the invention.

The fully assembled preferred embodiment is shown in FIGS. 13 and 14, which depict cover 20, pole standoffs 21, index pins 22, power LED 53, potentiometer 58, base 70, and fans 71 and 72.

Figure 15:
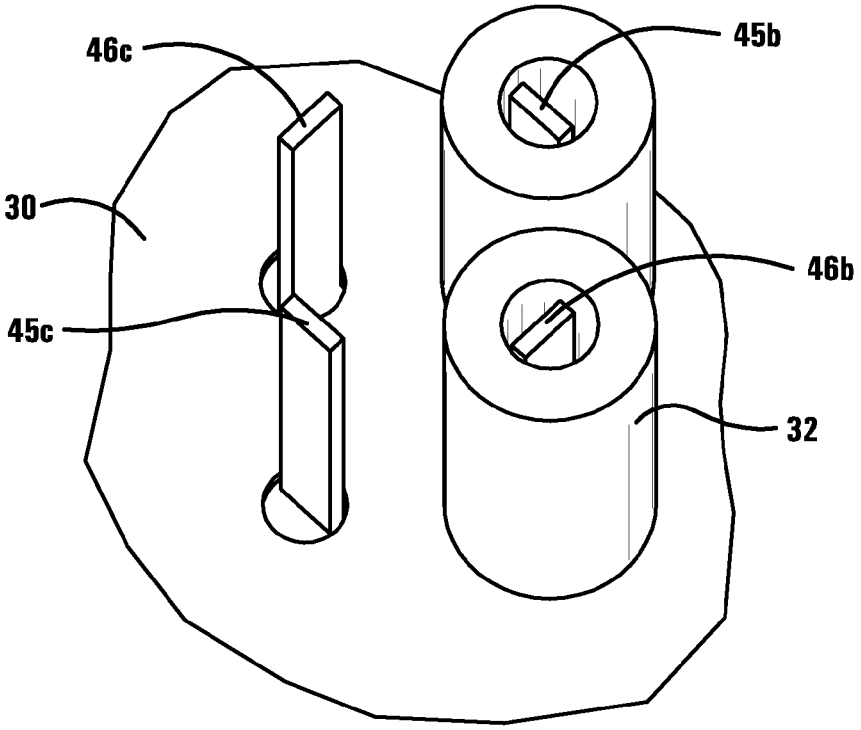
FIG. 15 is a perspective view of the magnetics board of an embodiment of the invention.
Figure 16:
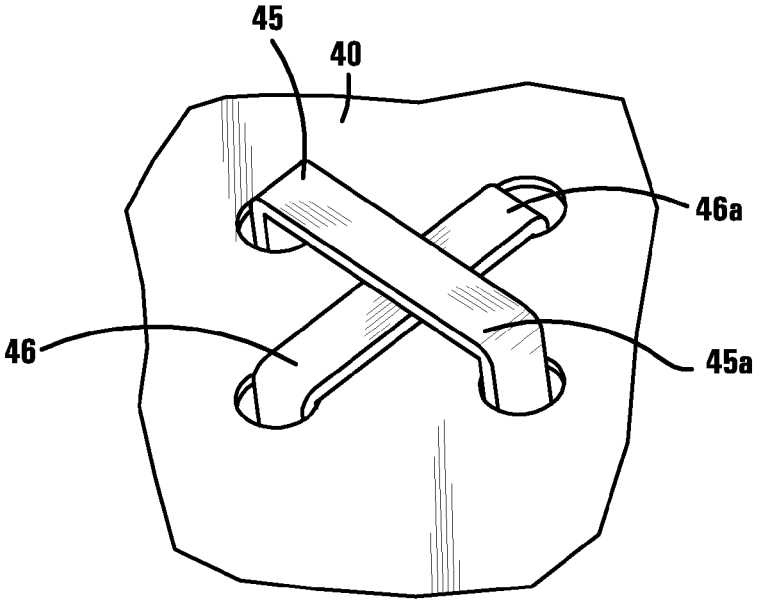
FIG. 16 is a perspective view of the coupling plane of an embodiment of the invention.

FIGS. 15 and 16 depict another embodiment of stirring apparatus 10 in which each vial group on magnetics board 30 is comprised of two air core coils. Further, coupling plane 40 contains a first U-shaped coupling piece 45 and a second U-shaped coupling piece 46. The first coupling piece 45 has a bottom 45*a*, first leg 45*b*, and second leg 45*c*. The second coupling piece 46 has a bottom 46*a*, first leg 46*b*, and second leg 46*c*. First and second coupling pieces 45 and 46 do not touch. The legs of first and second coupling pieces 45 and 46 pass through apertures in magnetics board 30. The first coil of the pair of coils 32 contains the first leg 45*b* of the first coupling piece 45. The second leg 45*c* of the first coupling piece 45 is located diagonal from said first leg 45*b* of the first coupling piece 45. The second coil of the pair of coils 32 contains the first leg 46*b* of the second coupling piece 46. Second leg 46*c* of the second coupling piece 46 is located diagonal from the first leg 46*b* of the second coupling piece 46. The first coil of the pair of coils 32 is connected to the first phase of stepper driver 60 and generates opposite magnetic field directions at the first leg 45b and the second leg 45*c* of the first coupling piece 45. The second coil of the pair of coils 32 is connected to the second phase of stepper driver 60 and generates opposite magnetic field directions at the first leg 46*b* and the second leg 46*c* of the second coupling piece 46. As seen in FIGS. 15-16, the legs are arranged in a rectangular pattern about an axis, such that one leg is located at each vertex of the rectangular pattern wherein the second leg 45*c* of the first coupling piece 45 is located diagonal across said axis from the first leg 45*b* of the first coupling piece 45, and the second leg 46*c* of the second coupling piece 46 is located diagonal across said axis from the first leg 46*b* of the second coupling piece 46.

In some variations of this embodiment, the distal end 21*a* of pole standoffs 21 enter into coils 32 and contact the first leg 45*b* and second leg 45*c* of the first coupling piece 45, and the first leg 46*b* and second leg 46*c* of the second coupling piece 46. In other variations of this embodiment, when the distal end 21*a* of pole standoffs 21 enter into coils 32, a gap is present between the distal end 21*a* of pole standoffs 21 and the first leg 45*b* and second leg 45*c* of first coupling piece 45, and the first leg 46*b* and second leg 46*c* of second coupling piece 46.

A user operates stirring apparatus 10 as follows: first, a user can optionally configure the stirring circuitry settings by removing cover 20, manipulating the first configuration header 64 to enable or disable the rectification and sleep mode functions, and manipulating the second configuration header 65 to select the logic supply voltage, direction of the magnetic field rotation, and step size. A user can select a 1/16, 1/4, 1/2 or full step size, which creates between 4 and 32 pole positions at intervals in each vial group of four coils 32. When a 1/16 step size is selected, 32 pole positions are created at intervals in each vial group.

After a user sets configuration headers 64 and 65, cover 20 is replaced and the 24 VDC power supply is connected to power supply connector 51. Next, a user places a vial rack containing target vials on cover 20. Index pins 22 position the vial rack on cover 20 such that each target vial is positioned above an individual vial group. Each vial group on magnetics board 30 generates an individual magnetic field that drives the magnetic stir bar contained in the target vial located above the vial group.

After the vial rack is in position, a user manipulates the switch in potentiometer 58 from the OFF position to the ON position, which allows power switch 52 to conduct current, thereby powering linear regulator 54, power LED 53, and fan power linear regulator 55. Linear regulator 54 supplies power to oscillator 59, potentiometer 58, and stepper driver 60. Stepper driver 60 is also supplied with 24 VDC, which is used to drive coils 32.

A user then adjusts the oscillation speed using potentiometer 58, which controls the output of oscillator 59 that is provided as an input to stepper driver 60. When stepper driver 60 receives an input from oscillator 59, stepper driver 60 advances the magnetic fields of the vial groups to the next pole position, thereby also advancing the coupled stir bars to the next pole position. Accordingly, when the step size is set to 1/16 (micro stepping mode) and potentiometer 58 is adjusted such that oscillator 59 produces an output of 300 Hz, the magnetic stir bars in target vials will spin at about 280 RPMs. Further, if the oscillator produces an output of 1280 Hz, the magnetic stir bars will spin at about 1200 RPMs.

This stirring apparatus 10 is well suited for use in conjunction with an unattended autosampler because micro stepping more effectively couples the stir bar to the pole location, thereby allowing for the use of smaller coils and less power. Further, since an individual magnetic field is provided at each vial location, a user can visually verify that the stir bar is synchronized with the magnetic field throughout the magnetic field's entire rotation before allowing the stirring apparatus 10 to operate unattended.

While this invention has been described in conjunction with the specific embodiments described above, it is evident that many alternatives, combinations, modifications and variations are apparent to those skilled in the art. Accordingly, the preferred embodiments of this invention, as set forth above are intended to be illustrative only, and not in a limiting sense. Various changes can be made without departing from the spirit and scope of this invention.

What is claimed is:

1. A stirring device comprising:

a magnetics board containing at least two adjacent groups of air core coils;

each of said groups of coils having four coils comprising a first pair of two coils and a second pair of two coils; each of said groups of four coils being located beside each other;

said two coils in said first pair are wound in opposite directions and energized by a first phase of electrical power, thereby producing oppositely oriented magnetic fields;

said two coils in said second pair are wound in opposite directions and energized by a second phase of electrical power, thereby producing oppositely oriented magnetic fields;

directly opposing coils from said adjacent groups of coils are energized by the same phase of power and produce a magnetic field oriented in the same direction;

a cover having a top surface, said cover being situated above said coils, said cover having an array of pole standoffs arranged such that the air core of each coil contains a portion of one pole standoff, said pole standoffs having a head and a distal end, said heads of said pole standoffs extend through said cover and are flush with the top surface of said cover.

2. The stirring device of claim 1 further comprising, a stepper motor driver outputting said first phase and said second phase of electrical power;

each of said groups of coils are arranged in a rectangular pattern;

said two coils in said first pair are positioned diagonally in the rectangular pattern;

said two coils in said first pair are connected in series;

said two coils in said second pair are positioned diagonally in the rectangular pattern; and said two coils in said second pair are connected in series.

3. The stirring device of claim 2, wherein the distance between adjacent coils of said adjacent groups is less than the distance between said two coils in said first pair;

the distance between adjacent coils of said adjacent groups is less than the distance between said two coils in said second pair.

4. The stirring device of claim 3, wherein said rectangular pattern is a square; said coils are connected to create multiple sets of parallel coils in series for each phase of electrical power.

5. The stirring device of claim 1, wherein a coupling plane is situated below said magnetics board.

6. The stirring device of claim 5, wherein said distal ends of said pole standoffs contact said coupling plane.

7. The stirring device of claim 5, wherein said distal ends of said pole standoffs and said coupling plane are separated by a gap.

8. The stirring device of claim 5, wherein said coupling plane has an array of coupling standoffs arranged such that the air core of each coil contains a portion of one coupling standoff, said coupling standoffs having a distal end.

9. The stirring device of claim 8, wherein said distal end of one of said pole standoffs contact said distal end of one of said coupling standoffs.

10. The stirring device of claim 8, wherein said distal end of one of said pole standoffs and said distal end of one of said coupling standoffs are separated by a gap.

11. A stirring device comprising a magnetics board and a coupling board; said coupling board being situated below said magnetics board;

said magnetics board having a group of coils comprising a first coil and a second coil; said coupling board having a first coupling piece and a second coupling piece;

said first coupling piece having a first leg and a second leg; said second coupling piece having a first leg and a second leg; said legs of said coupling pieces extend through apertures in said magnetics board; said first coil containing at least a portion of said first leg of said first coupling piece; said second coil containing at least a portion of said first leg of said second coupling piece;

said legs are arranged in a rectangular pattern about an axis, such that one leg is located at each vertex of said rectangular pattern; and the second leg of the first coupling piece is located diagonal across said axis from the first leg of the first coupling piece, and the second leg of the second coupling piece is located diagonal across said axis from the first leg of the second coupling piece;

wherein said first coupling piece and said second coupling piece do not touch.

12. A stirring device comprising:

a magnetics board containing at least two adjacent groups of air core coils;

each of said groups of coils having four coils comprising a first pair of two coils and a second pair of two coils; each of said groups of four coils being located beside each other;

said two coils in said first pair are wound in opposite directions and energized by a first phase of electrical power, thereby producing oppositely oriented magnetic fields;

said two coils in said second pair are wound in opposite directions and energized by a second phase of electrical power, thereby producing oppositely oriented magnetic fields; and directly opposing coils from said adjacent groups of coils are energized by the same phase of power and produce a magnetic field oriented in the same direction.

13. The stirring device of claim 12 further comprising, a stepper motor driver outputting said first phase and said second phase of electrical power;

each of said groups of coils are arranged in a rectangular pattern;

said two coils in said first pair are positioned diagonally in the rectangular pattern;

said two coils in said first pair are connected in series;

said two coils in said second pair are positioned diagonally in the rectangular pattern;

said two coils in said second pair are connected in series;

a cover having a top surface, said cover being situated above said coils, said cover having an array of pole standoffs arranged such that the air core of each coil contains a portion of one pole standoff; and said pole standoffs having a head and a distal end, said heads of said pole standoffs extend through said cover and are flush with the top surface of said cover.

14. The stirring device of claim 13, wherein the distance between adjacent coils of said adjacent groups is less than the distance between said two coils in said first pair;

the distance between adjacent coils of said adjacent groups is less than the distance between said two coils in said second pair; wherein said rectangular pattern is a square; said coils are connected to create multiple sets of parallel coils in series for each phase of electrical power.

15. The stirring device of claim 13, wherein a coupling plane is situated below said magnetics board.

16. The stirring device of claim 15, wherein said distal ends of said pole standoffs contact said coupling plane.

17. The stirring device of claim 15, wherein said distal ends of said pole standoffs and said coupling plane are separated by a gap.

18. The stirring device of claim 15, wherein said coupling plane has an array of coupling standoffs arranged such that the air core of each coil contains a portion of one coupling standoff, said coupling standoffs having a distal end.

19. The stirring device of claim 18, wherein said distal end of one of said pole standoffs contact said distal end of one of said coupling standoffs.

20. The stirring device of claim 18, wherein said distal end of one of said pole standoffs and said distal end of one of said coupling standoffs are separated by a gap.

* * * * *